US009993944B2

(12) United States Patent
Paige

(10) Patent No.: US 9,993,944 B2
(45) Date of Patent: Jun. 12, 2018

(54) VOLUMETRIC MIXER WITH WATER TANK AND OIL TANK INSIDE AGGREGATE BIN

(71) Applicant: OMEGA MIXERS, L.L.C., Ankeny, IA (US)

(72) Inventor: Daniel Paige, Ankeny, IA (US)

(73) Assignee: Omega CM Delta, LLC, West Des Moines, IA (US)

( * ) Notice: Subject to any disclaimer, the term of this patent is extended or adjusted under 35 U.S.C. 154(b) by 1074 days.

(21) Appl. No.: 14/269,844

(22) Filed: May 5, 2014

(65) Prior Publication Data

US 2015/0314482 A1 Nov. 5, 2015

(51) Int. Cl.

| | |
|---|---|
| ***B28C 9/04*** | (2006.01) |
| ***B01F 13/00*** | (2006.01) |
| ***B28C 5/38*** | (2006.01) |
| ***B28C 7/00*** | (2006.01) |
| ***B28C 7/02*** | (2006.01) |

(52) U.S. Cl.

CPC ..... *B28C 9/0463* (2013.01); *B01F 13/0013* (2013.01); *B01F 13/0037* (2013.01); *B28C 5/38* (2013.01); *B28C 7/003* (2013.01); *B28C 7/02* (2013.01); *B28C 9/0454* (2013.01); *B01F 2215/0047* (2013.01)

(58) Field of Classification Search

CPC ..... B28C 9/0463

See application file for complete search history.

(56) References Cited

U.S. PATENT DOCUMENTS 3,456,925 A * 7/1969 Gallagher ..... B28C 9/0463 366/27
4,285,598 A * 8/1981 Horton ..... B28C 9/0454 222/137
4,922,463 A * 5/1990 Del Zotto ..... B28C 9/0463 222/189.06
5,261,739 A * 11/1993 da Costa Goncalves ..... B28C 7/0858 366/30
5,730,523 A * 3/1998 Flood ..... B28C 7/02 366/18
5,971,600 A * 10/1999 Paterson ..... B01F 13/0013 366/150.1
6,876,904 B2 * 4/2005 Oberg ..... B28C 7/0418 366/17
7,931,397 B2 * 4/2011 Lindblom ..... B28C 5/4213 220/563
2009/0180348 A1 7/2009 Long, Jr.

FOREIGN PATENT DOCUMENTS

| | | |
|---|---|---|
| EP | 0816032 | 1/1998 |
| EP | 2155456 | 11/2012 |
| EP | 1773551 | 6/2013 |

* cited by examiner

*Primary Examiner* — Abbas Rashid

(74) *Attorney, Agent, or Firm* — McKee, Voorhees & Sease, PLC

(57) ABSTRACT

A mobile concrete mixing unit has an aggregate bin divided into two compartments by a water tank provided within the aggregate bin. A hydraulic reservoir is provided within the water tank in order to cool the hydraulic fluid within the hydraulic reservoir and warm the water within the water tank. The water tank also helps to keep the aggregate warm and flowable when used in low temperatures. A lower portion of the water tank includes sides that slope inwardly so that aggregate within the bin can drop freely onto a conveyor belt without bridging between the water tank and the sidewalls of the aggregate bin.

20 Claims, 8 Drawing Sheets

VOLUMETRIC MIXER WITH WATER TANK AND OIL TANK INSIDE AGGREGATE BIN

FIELD OF THE INVENTION

This invention relates generally to concrete mixers, and more particularly to mobile concrete mixers that make concrete on a volumetric basis, rather than on a batch basis.

BACKGROUND OF THE INVENTION

Concrete is an important and well-known structural material. It is used primarily as a paving material, but also to provide foundations, and other structural components. Concrete is a mixture of cement and aggregates. The most common cement is Portland cement, but other binding materials are also well-known and commonly used. The aggregates include rocks, sand, and other similar materials of varying sizes. The dry cement is mixed with water and the aggregate to form the concrete. Additionally, various other chemicals and admixtures may be included in the mixture depending upon the intended use of the concrete, as well as environmental factors such as temperature and relative humidity at the time the concrete is being mixed and poured.

Traditionally, concrete has been mixed in relatively large stationary mixing plants, and then loaded on to a truck with a rotating barrel to be transported to a job site. The rotating barrel keeps the concrete mixer flowable and mixed, until the truck can arrive at the job site.

Recently, mobile concrete mixing units have been developed that mix and dispense the concrete at the job site as it is needed. This is advantageous as it eliminates the need for transporting the wet concrete mixture. Additionally, it takes a lot of the guesswork out of trying to get the proper mixture to match the conditions at the job site. Moreover, many concrete mixtures begin deteriorating after they are mixed, and are subject to spoilage before they reach the job site. Some of these mobile concrete mixtures are of a volumetric nature, as opposed to a batch nature. That means that the stream of concrete leaving the mixer should be uniform at each time the mixture is being dispensed. In other words, the ratio of components in any given volume of the mixture should be uniform. In a batch system it is only necessary to assure that the ratio of ingredients in the entire batch matches a set standard.

The present invention is directed to overcoming challenges associated with volumetric mobile concrete mixers. Such mobile volumetric mixers commonly use hydraulics to mix the various components of the concrete. Because a concrete is relatively bulky and heavy the hydraulic systems can generate a lot of heat in the hydraulic fluid that needs to be dissipated. This can require a large volume of hydraulic fluid.

In cooler climates, as the air temperature approaches and drops below the freezing point of water, it can be difficult or impossible to mix and pour concrete that is structurally sound. In some climates this can significantly limit the number of days the mobile mixing unit can be used. Using warmer water can help in some cases, and will permit the mixing and pouring of concrete in colder temperatures; however, the water can quickly cool if its container is not insulated or heated.

Commonly, the volumetric mobile mixers include an aggregate bin situated above a moving belt. The belt is used to deliver the aggregate to a mixing area where it is mixed with the dry cement powder and water. It is known to divide the aggregate bin into separate chambers above the belt such that two types of aggregate may be included in the bin and mixed into the concrete. In these divided chambers, occasionally the weight of the aggregate upon itself can cause it to pack tightly enough to form a bridge between the divider and the sidewall of the bin once the belt starts moving, such that the aggregate stops freely flowing onto the belt. This can cause non-uniform mixtures. The bridging issue can be especially acute in cold temperatures when moisture within the aggregate can cause the aggregate to freeze together.

Another difficulty with mobile volumetric mixers is that the large volume of water can cause the unit to be unstable, especially when the water sloshes from side-to-side of the water storage tank during transportation, and also if the unit is on a significant side grade.

Another difficulty with using mobile volumetric mixers during cold weather is maintaining the water at a sufficiently high temperature to properly activate the cement.

A further issue related to mobile concrete mixers is the stability of the vehicle when cornering or driving on a side grade. The water tank can make the vehicle top heavy, and can cause the center of gravity to shift laterally as back and forth as the water sloshes within the tank.

Therefore, an objective of the present invention is to provide an improved volumetric concrete mixing system that includes a water tank within the aggregate bin.

It is another object of the present invention to provide a hydraulic fluid reservoir within the water tank in order to remove heat from the hydraulic fluid and warm the water.

It is a further objective of the present invention to provide a water tank within an aggregate bin of a volumetric mobile concrete mixer, such that the water tank serves to divide the aggregate bin into two separate compartments while also reducing the likelihood of bridging occurring within the aggregate.

It is a further object of the present invention to provide a mobile volumetric concrete mixer that has improved performance in cold temperatures.

SUMMARY OF THE INVENTION

According to one embodiment, the present invention is directed to a mobile concrete mixing unit that has a mobile frame with an aggregate bin mounted to the mobile frame. The aggregate bin includes a front wall, a rear wall, and sidewalls that span between the front and rear walls. Each of the sidewalls slopes downwardly and inwardly towards each other at a lower portion. A water tank is located within the aggregate bin. The water tank spans between the front wall and the rear wall of the aggregate bine. The water tank divides an upper portion of the aggregate bin into a first storage area and a second storage area, the first and second storage areas being open at a lower end. The water tank includes a water outlet for dispensing water. A conveyor belt is mounted to the frame below the lower ends of the first and second storage areas. A hydraulics system provides power to the mixing unit. The hydraulics system includes a reservoir of hydraulic fluid. The reservoir of hydraulic fluid is located at least partially within the water tank. A cement bin is mounted on the mobile frame. A control system controls operation of the conveyor belt, hydraulics system, and water outlet to mix aggregate from the aggregate bin, cement from the cement bin, and water from the water tank to form a concrete mixture, whereby heat from the hydraulics system is transferred into water within the water tank to cool the hydraulics system and warm the water. A lower portion of the water tank may slope downwardly and inwardly to prevent aggregate within the aggregate bin from bridging. A first baffle may be included within the water tank. The first baffle may be a plate spanning across a width of the water tank, including a plurality of openings to permit flow of water through the first baffle. A second baffle including a second plurality of opening to permit flow of water through the second baffle may also be provided in the water tank. A divider flange may extend downwardly from the lower portion of the water tank towards the belt. A resilient separator may be mounted to the divider flange and extend below the divider flange into close engagement with the belt. The reservoir of hydraulic fluid may include a hydraulic fluid inlet connected to an outlet of the hydraulics system and a hydraulic fluid outlet connected to a suction line of the hydraulics system, and the reservoir of hydraulic fluid may include a divider plate separating the hydraulic fluid inlet and the hydraulic fluid outlet to cause a flow of hydraulic fluid within the reservoir to thereby increase heat transfer between the hydraulic fluid within the reservoir and water within the water tank. A support rod may be mounted between one of the sidewalls of the aggregate bin and a sidewall of the water tank. The mobile frame may include a plurality of ribs that support the aggregate bin on the mobile frame, and the support rod may be aligned with one of the ribs.

According to another embodiment, the present invention is a mobile concrete mixing unit with a mobile frame and an aggregate bin mounted to the mobile frame. The aggregate bin includes a front wall, a rear wall, and sidewalls that span between the front and rear walls, with each of the sidewalls sloping inwardly towards each other at a lower portion. A water tank is located within the aggregate bin. The water tank spans between the front wall and the rear wall, with the water tank dividing an upper portion of the aggregate bin into a first storage area and a second storage area. The first and second storage areas are open at their lower ends. The water tank includes a water outlet for dispensing water. A conveyor belt is provided below the lower ends of the first and second storage areas. A lower portion of the water tank slopes inwardly away from the sidewalls of the aggregate bin to prevent aggregate within the aggregate bin from bridging. A first baffle may be provided within the water tank. The first baffle may be formed by a plate spanning across a width of the water tank with a plurality of openings to permit flow of water through the first baffle. A second baffle may also be provided within the water tank, including a second plurality of opening to permit flow of water through the second baffle. A divider flange may extend downwardly from the lower portion of the water tank towards the belt. A resilient separator may be mounted to the divider. A hydraulics system may be provided for providing power to the mixing unit. The hydraulics system can have a reservoir of hydraulic fluid, the reservoir of hydraulic fluid being located within the water tank enclosure. A control system may control operation of the conveyor belt, hydraulics system, and water outlet to mix aggregate from the aggregate bin, cement from the cement bin, and water from the water tank to form a concrete mixture, whereby heat from the hydraulics system is transferred into water within the water tank to cool the hydraulics system and warm the water. The reservoir of hydraulic fluid may include a hydraulic fluid inlet connected to an outlet of the hydraulics system and a hydraulic fluid outlet connected to a suction line of the hydraulics system. The reservoir of hydraulic fluid may include a horizontal divider plate separating the hydraulic fluid inlet and the hydraulic fluid outlet to cause a flow of hydraulic fluid within the reservoir to thereby increase heat transfer between the hydraulic fluid within the reservoir and water within the water tank. A support rod may be mounted between one of the sidewalls of the aggregate bin and a sidewall of the water tank. The mobile frame may include a plurality of ribs that support the aggregate bin on the mobile frame. The support rod may be aligned with one of the ribs.

Several benefits arise from locating the water tank inside in the aggregate bin with the hydraulic tank inside water tank, including: (1) Keeping the hydraulic oil cool. Even if water is hot, the water temperature will be less than hydraulic oil temperature. This also reduces the volume of hydraulic fluid needed for the system. (2) Preventing aggregates from freezing. The aggregates absorb heat from the water tank to help keep the aggregate above freezing and free flowing. (3) Maintaining water temperature. Typically in cold temps, aggregates are heated before loading, or else the loaded unit is kept in a heated location prior to use. The sand and gravel surrounding the water tank insulates the water tank and reduces heat loss from the tank to the environment.

The stability of the mobile mixer is improved by the location and shape of the water tank within the aggregate bin which lowers the overall center of gravity and maintains it closer to the longitudinal centerline of the unit. Additionally, internal baffles reduce sloshing of water, which in turn improves stability, especially during cornering and on side grades.

DETAILED DESCRIPTION OF THE PREFERRED EMBODIMENTS

Figure 1:
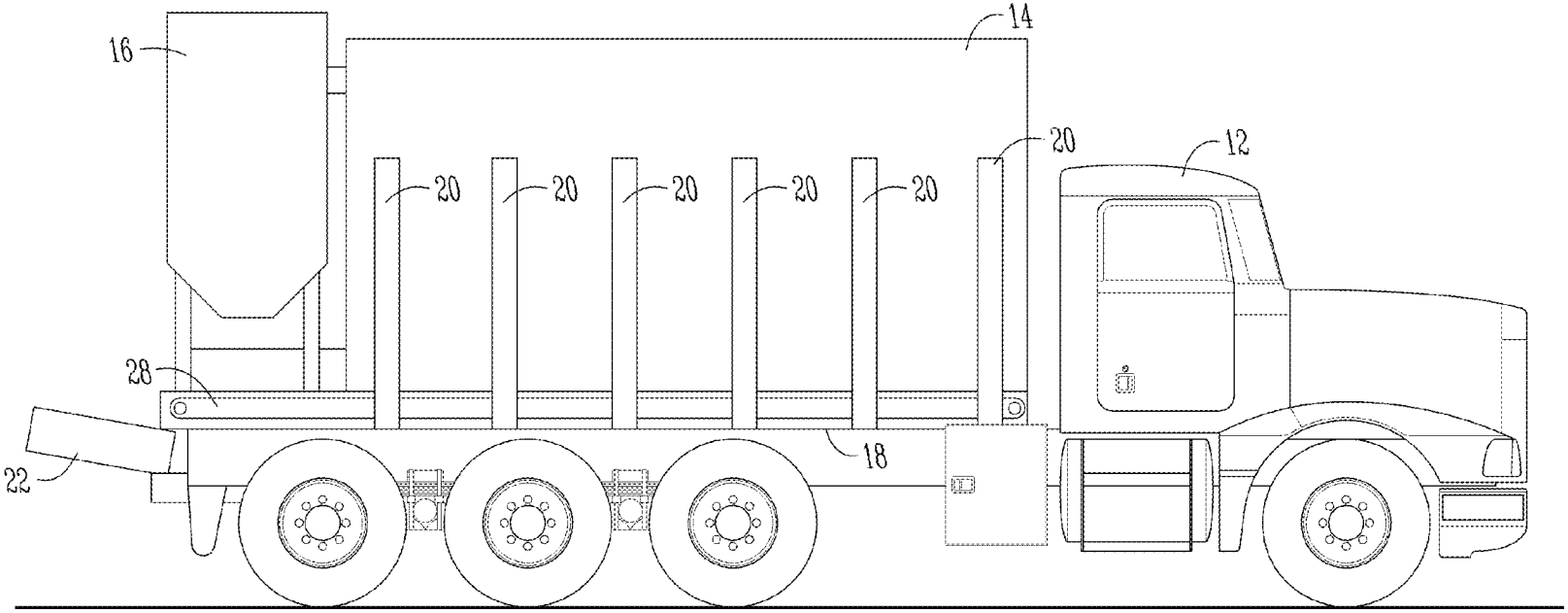
FIG. 1 is a side elevation view of a mobile concrete mixing unit according to one embodiment of the present invention provided on a truck.

FIG. 1 shows a side elevation view of a mobile concrete mixing unit 10 according to one embodiment of the present invention. The mixing unit 10 is mounted on a truck 12. The truck 12 can be used to transport the mixing unit 10 to a desired location where the mixing unit 10 can be used to continuously mix and dispense a concrete mixture. The mixing unit 10 includes a large aggregate bin 14 and a relatively smaller cement bin 16 mounted on a supporting frame 18. The support frame 18 includes ribs 20 that extend upwardly and support the aggregate bin 14. In operation, aggregate from the aggregate bin 14 is mixed with dry cement from the cement bin 16 along with water, and in some cases additional admixtures, to form a concrete mixture that is dispensed through chute 22.

Figure 2:
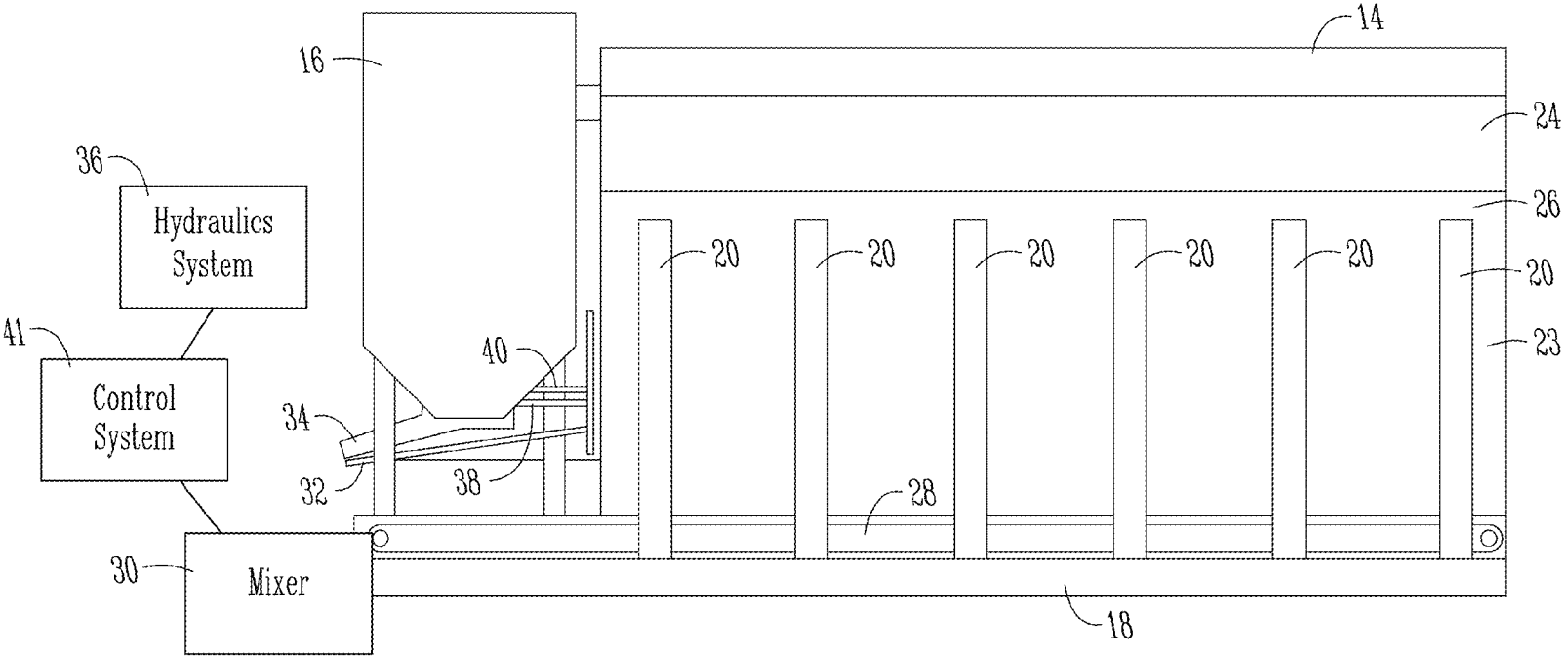
FIG. 2 is a side elevation view of a mobile concrete mixing unit according to one embodiment of the present invention.

FIG. 2 is a side elevation view of the concrete mixing unit 10 apart from the truck 12. The aggregate bin 10 includes sidewalls 23 that have an upper portion 24 that is generally vertically oriented and a lower portion 26 that is sloped inwardly towards a center line of the unit. The ribs 20 extend upwardly from a framework 18 to support the lower portion 26 of the sidewalls of the aggregate bin 14. A continuous conveyor belt 28 is supported by the frame 18 and is provided directly beneath the aggregate bin 14. The conveyor belt 28 is used to carry aggregate from the aggregate bin 14 to a mixer 30 where the aggregate is mixed with cement powder from the cement bin 16 as well as water from a water tank (see FIGS. 3-7) within the aggregate bin 14 to form a concrete mixture. A water conduit 32 extends forwardly from the aggregate bin 14 to provide water to the mixer 30. The cement bin 16 includes a dispensing apparatus 34 that is used to dispense cement powder from the cement bin 16 to the mixer 30. A hydraulics system 36 is used to power the conveyor belt 28 as well as the mixer 30. The hydraulics system 36 uses hydraulic fluid that is carried in suction line 38 and exhaust line 40 that connect with a hydraulic fluid reservoir (see FIGS. 7-9) that is contained within the water tank (see FIGS. 3-7) provided within the aggregate bin 14.

Figure 3:
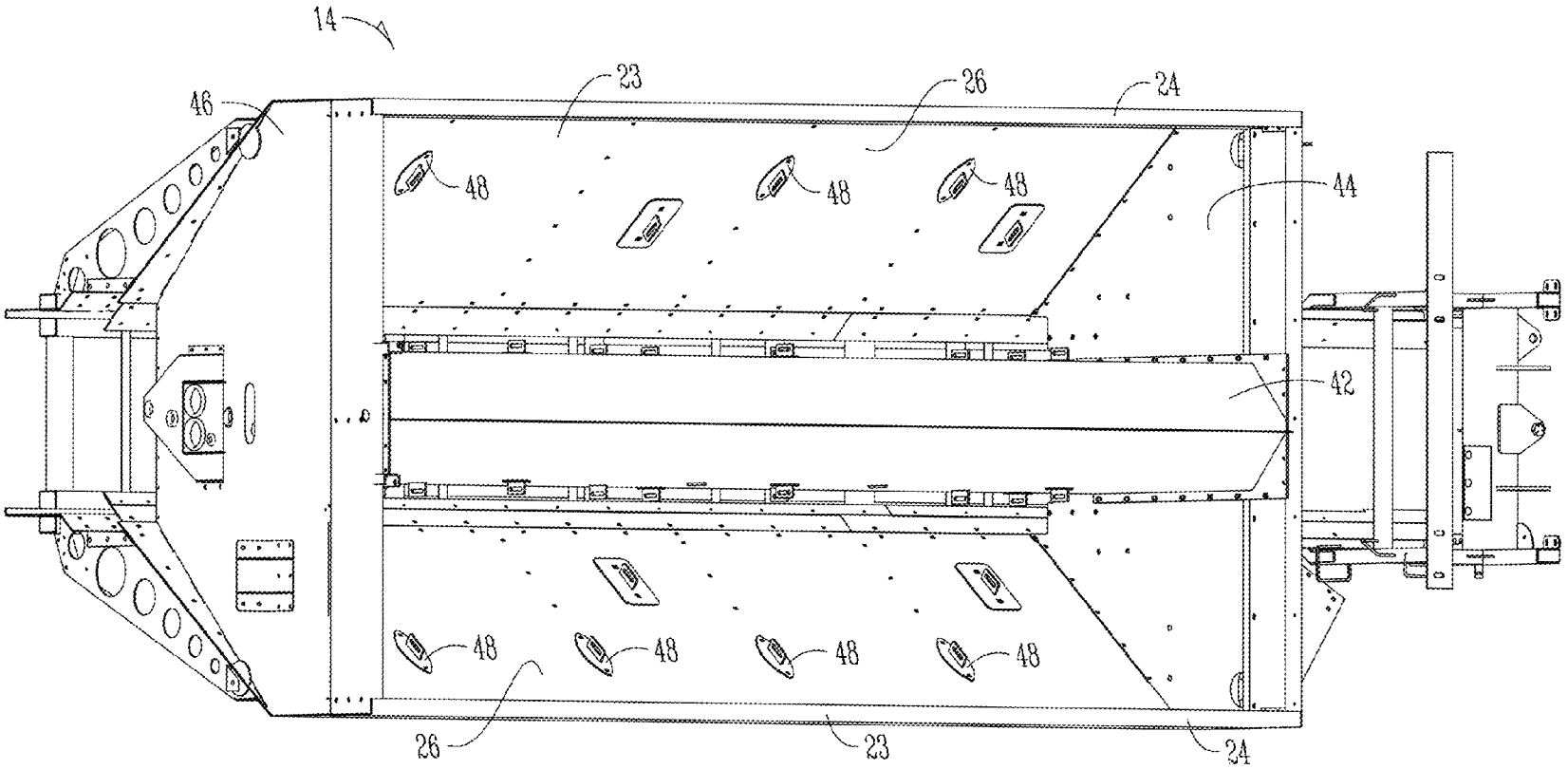
FIG. 3 is a perspective view taken generally from the top and left of an aggregate bin and water tank according to one embodiment of the present invention.
Figure 4:
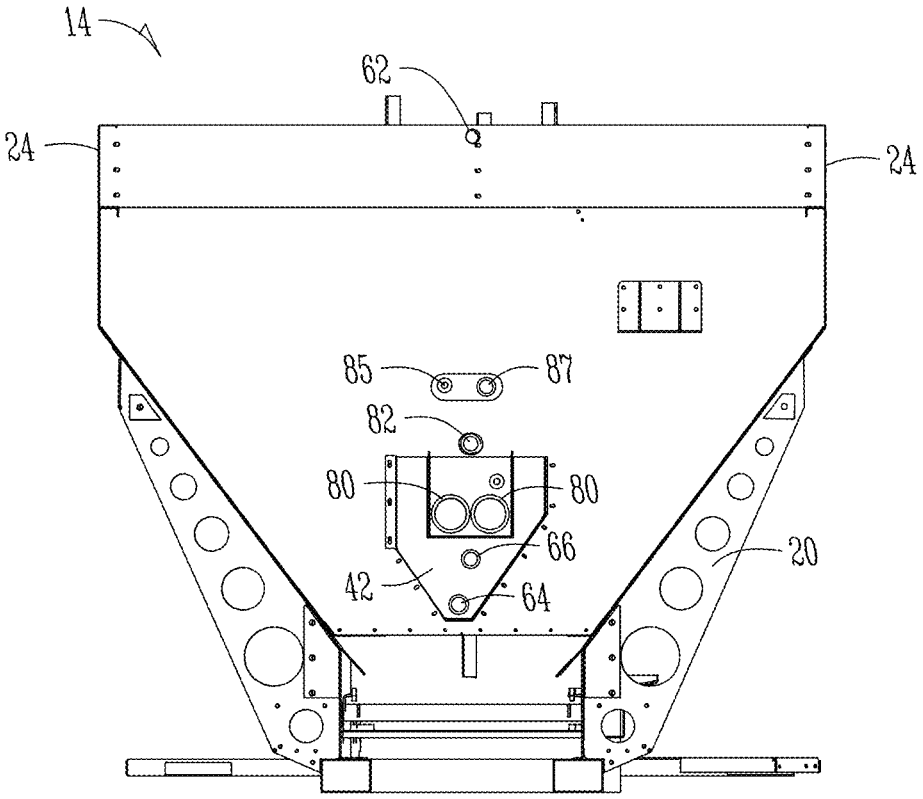
FIG. 4 is a left side elevation view of the aggregate bin and water tank of FIG. 3.

FIGS. 3 and 4 show the aggregate bin 14 with an included water tank 42 mounted generally along a longitudinal center line of the aggregate bin 14. The water tank 42 thereby divides the aggregate bin 14 into separate compartments that can be loaded with different types of aggregate. Alternatively, both compartments could include the same type of aggregate. The aggregate bin 14 includes a front wall 44 and a rear wall 46. The front and rear walls 44 and 46 are generally oriented in a vertical plane. Sidewalls 23 span between the front and rear walls 44 and 46, including upper portions 24 and inwardly sloped lower portions 26. The water tank 42 extends partially through the rear wall 46 such that a user will have direct access to the inlets and outlets of the water tank 42 from outside the aggregate bin 14. An inward slant of the rear wall 46 facilitate a lower portion of the water tank 42 extending through the wall 46.

A series of brackets 48 extend inwardly from the sloped lower portions 26 of the sidewalls 23. These brackets 48 are each aligned with a corresponding rib 20. In a preferred embodiment, the brackets 48 are each affixed directly to a corresponding rib 20 and extend through the sidewall lower portions 26. A corresponding set of brackets 49 are provided on the walls of the water tank 42. Tie rods 50 are provided between the brackets 48 and brackets 49 in order to help support the water tank 42. Additionally, supplemental brackets 52 and 53 may be mounted on the upper portions 24 of the sidewalls and the water tank 42 respectively. Supplemental tie rods 54 may be mounted between the brackets 52 and 53 to provide additional stability for the water tank 42 within the bin 14.

Figure 5:
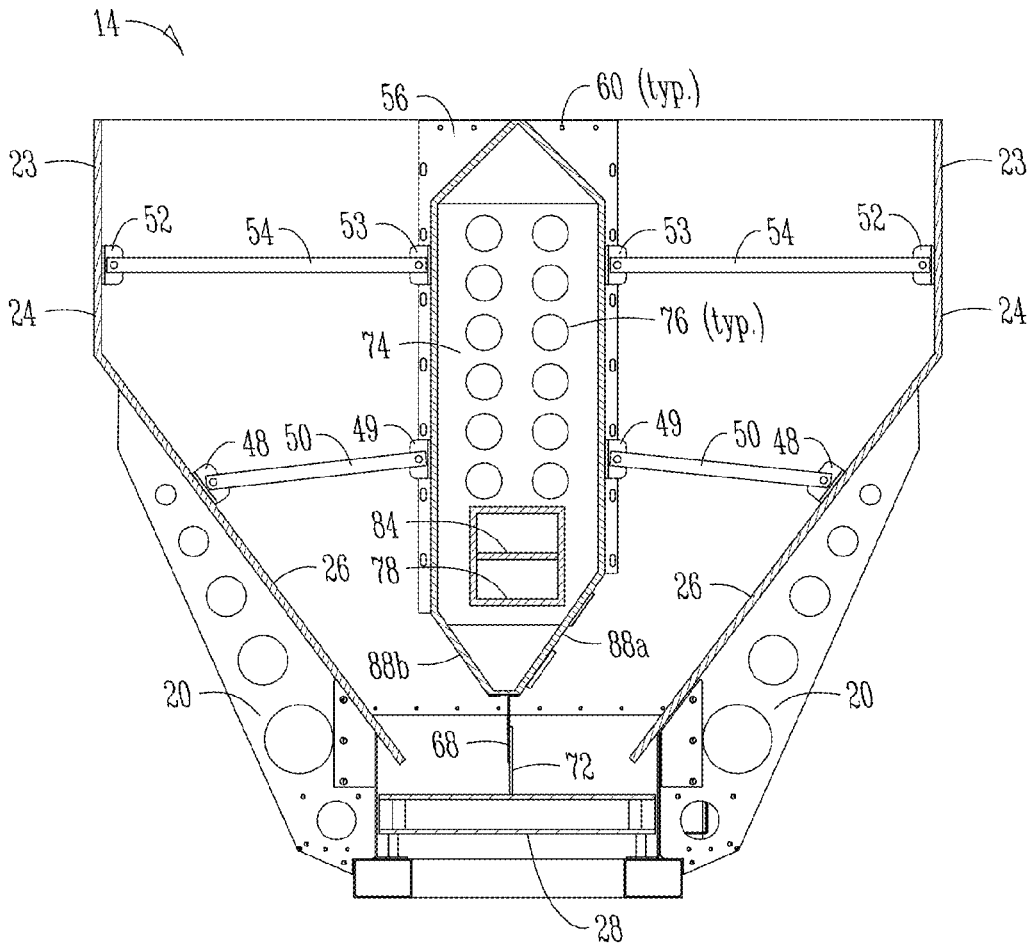
FIG. 5 is a partial cross-section view of the aggregate bin and water tank of FIG. 4.
Figure 6:
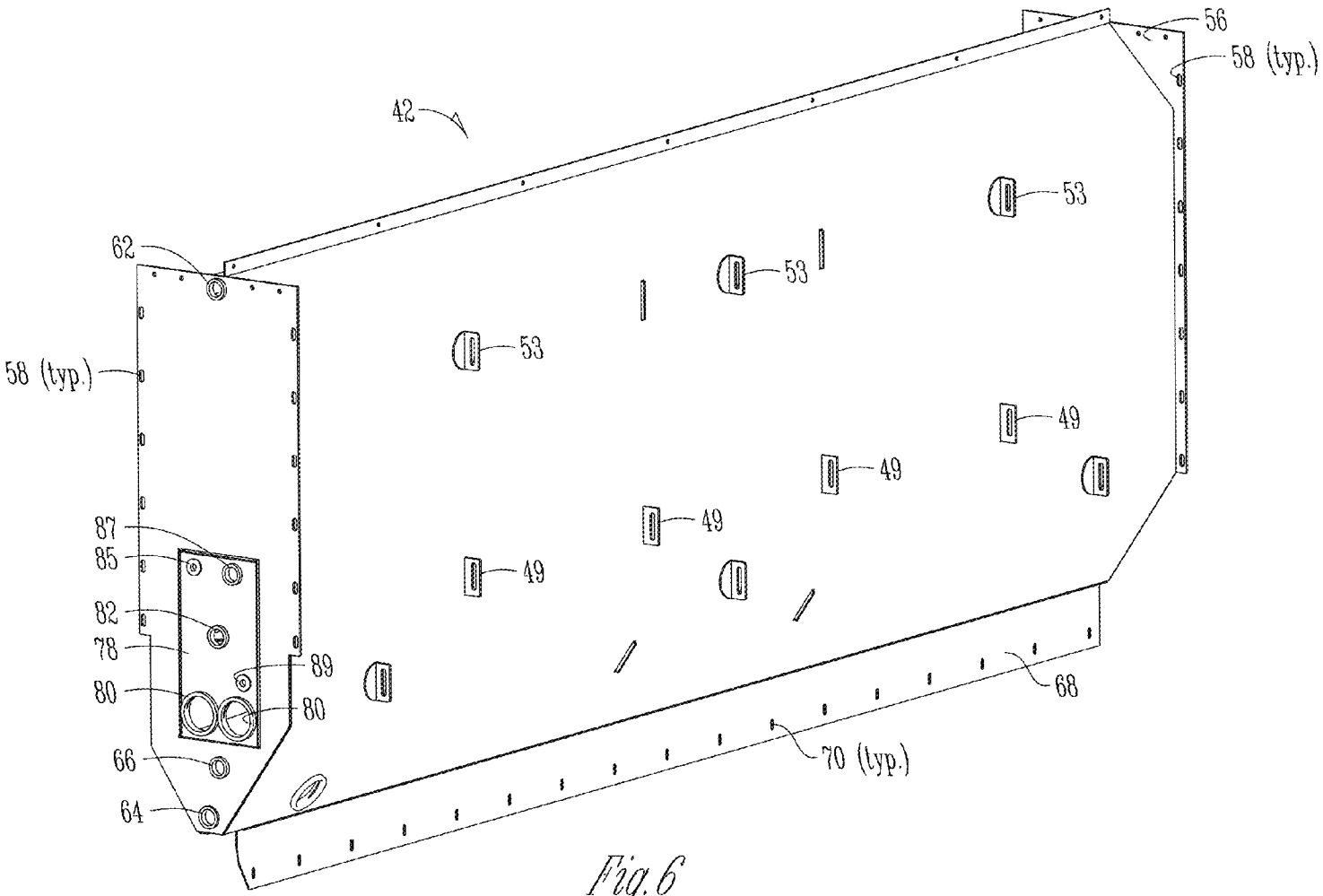
FIG. 6 is an isometric view of a water tank according to one embodiment of the present invention.

As best seen in FIGS. 5 and 6, each end of the water tank 42 has attached integrally therewith an end plate 56. Each of the end plates 56 has a plurality of mounting holes 58 for receiving bolts 60 that are used to secure the water tank 42 to the front and rear walls 44 and 46 of the aggregate bin 14.

The water tank 42 is provided with a vent opening 62 near the top of end plate 56. This vent opening 62 prevents a vacuum from forming above the water as the tank 42 is emptied, and prevents pressure build-up as the tank 42 is filled. The rear wall of the water tank 42 also includes a water inlet and outlet 64 that connects with water conduit 32 to provide water to the mixer 30. The water inlet and outlet 64 is used to provide an inlet to fill the tank 42 and to provide and outlet for water to the mixer 30 when concrete is being mixed. A manual valve (not shown) may be connected with outlet 64 to manually turn off the water supply. The rear wall of the water tank 42 may also include an opening 66 to attach a water level gauge. The rear wall of the water tank 42 also includes a hydraulic fluid vent opening 85 to provide a vent for the hydraulic fluid reservoir 78. A hydraulic fluid filling opening 87 is provided is provided adjacent to the vent opening 85 to permit adding hydraulic fluid to the hydraulic fluid reservoir 78 from outside the aggregate bin 14 and water tank 42. A sight tube opening 89 is provided to permit attachment of a clear tube attached to the hydraulic fluid reservoir 78 to permit a visual inspection of the hydraulic fluid. As an alternative to a clear tube, a sensor may be located at the opening 89 to monitor hydraulic fluid level.

A divider flange 68 extends downwardly from the lower extreme of the water tank 42. The divider flange 68 may be an angle that is welded, or otherwise secured to the bottom surface of the tank 42, as best seen in FIGS. 5 and 6. The divider flange 68 includes a plurality of mounting openings 70. These mounting openings 70 are used to mount a resilient separator 72 to the divider flange 68. This resilient separator 72 (shown in FIG. 5) extends generally downwardly from the divider flange 68 towards the conveyor belt 28. The divider flange 68 and resilient separator 72 are useful for maintaining two different types of aggregate separate from each other on the conveyor belt 28 until they reach the mixer 30.

Figure 7:
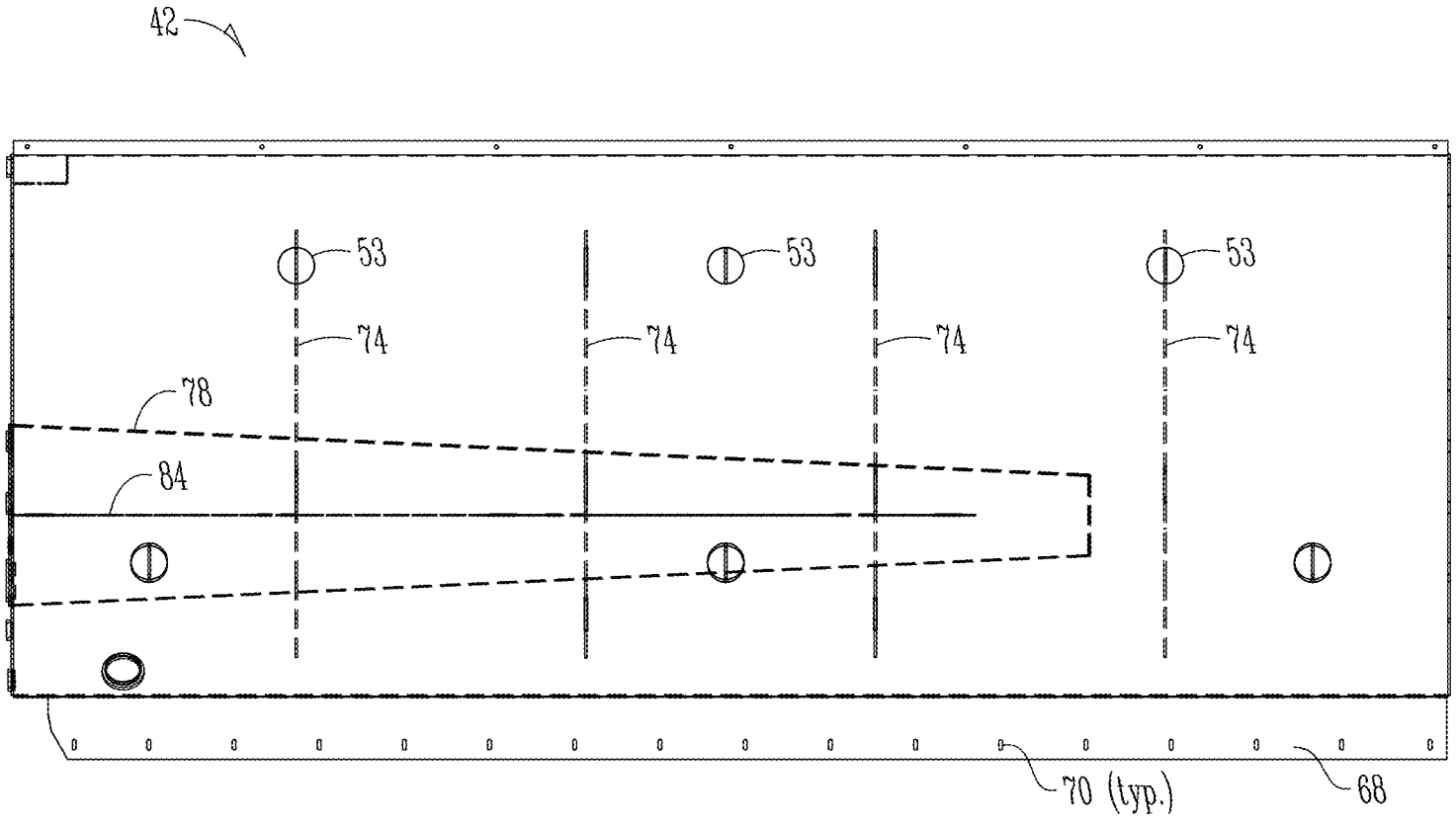
FIG. 7 is a side elevation view of the water tank of FIG. 6 with broken lines indicating the location of the hydraulic fluid reservoir and the water baffles within the water tank.

One or more baffles 74 may be provided inside the water tank 42 to prevent water from within the tank 42 from sloshing excessively, especially during transportation of the unit 10. Each of the baffles 74 may take the form of a flat plate with a plurality of openings 76 that permit water to flow through the baffles 74. Each of the baffles 74 may span between the sidewalls of the water tank 42 and may be welded in place. In FIG. 7, the placement of the baffles 74 within the water tank 42 is indicated by dashed lines.

Figure 8:
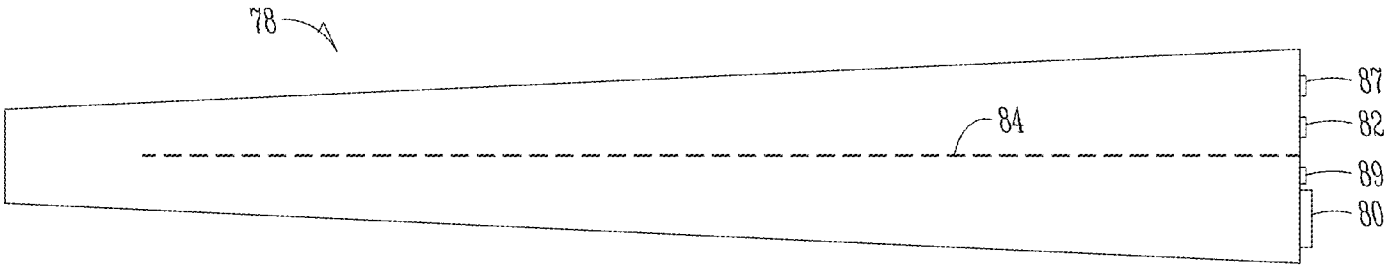
FIG. 8 is a side elevation view of a hydraulic fluid reservoir according to one embodiment of the present invention with a broken line indicating the location of a baffle plate within the reservoir.
Figure 9:
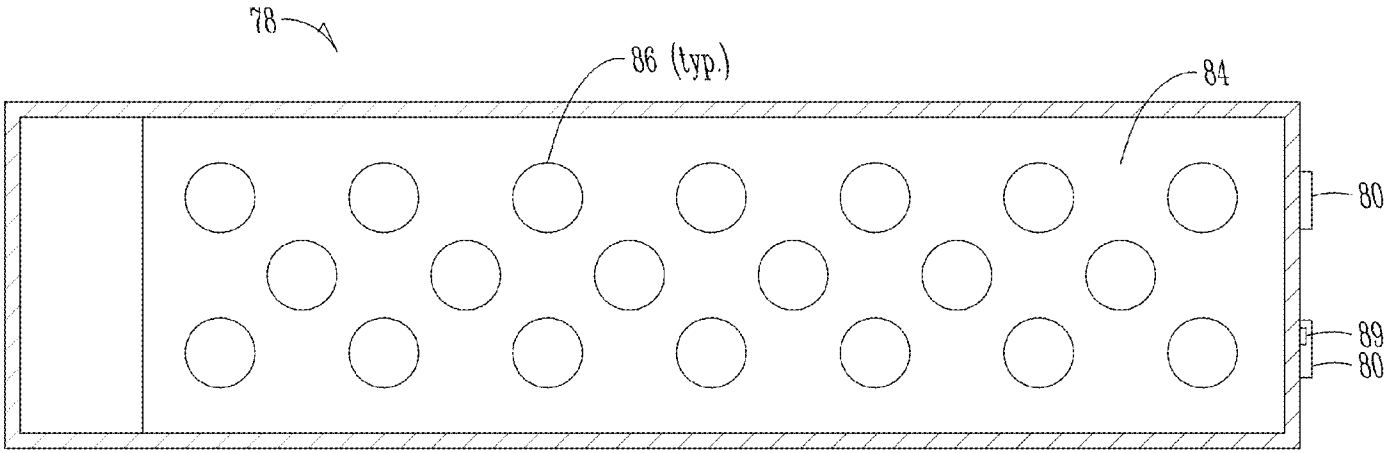
FIG. 9 is a cross-sectional view of the hydraulic fluid reservoir of FIG. 8.

A hydraulic fluid reservoir 78 may be provided within the water tank 42. The hydraulic fluid reservoir 78 is inserted into the water tank 42 through an opening in the rear end plate 56. The hydraulic fluid reservoir 78 has a shape of a generally tapered prism that is relatively wider at its base where it connects to the end plate 56, and relatively narrower at a distal end. The proximal end of the hydraulic fluid reservoir 78 includes openings 80 that connect to suction lines 38 of the hydraulic system 36 in order to provide cooled hydraulic fluid to the hydraulic system 36. The hydraulic fluid reservoir 78 also includes an opening 82 that acts as an inlet to receive relatively hot hydraulic fluid from the exhaust (return) line 40 connected to hydraulic system 36. The openings 80 and 82 may have standard fittings attached to permit easy and sealed coupling with the suction line 38 and exhaust line 40 respectively. A horizontal divider plate 84 is provided within the reservoir 78 to encourage the hydraulic fluid to flow along the walls of the reservoir as it flows from the inlet 82 to the outlets 80. The divider plate includes a plurality of openings 86 that permit the hydraulic fluid to flow through the divider plate. These openings are especially helpful when the unit is on a slope that might cause the fluid to pool at one end of the reservoir 78. In FIG. 8, the position of the baffle 84 within the reservoir 78 is indicated by a dashed line. Preferably, the reservoir 78 will be formed from a material that is a good heat conductor, such as metal, in order to enhance heat transfer from the hydraulic fluid within the reservoir 78 to the water surrounding the reservoir 78 within the water tank 42. In operation, as hydraulic fluid enters the reservoir through inlets 82 near the top of the reservoir 78, the warm hydraulic fluid with generally flow along the baffle plate 84 towards the distal end of the reservoir 78, and then return below the baffle plate 84 to outlets 80. Additionally, some of the hydraulic fluid may drop through the openings 86 to be returned to the outlets 80.

The water tank 42 includes a lower portion having sides 88*a* and *b* that slope inwardly. This inward slope of the lower portion 88*a* and *b* of the water tank 42 is advantageous because it permits the aggregate to spread to a cavity as it drops onto the belt 28. This prevents an impingement point between the water tank 42 and the sidewalls 26 of the aggregate bin 14, which can cause compaction of the aggregate, and disadvantageously, can lead to a bridging effect whereby a bridge is formed between the water tank 42 and the sidewall 26 such that the aggregate above the bridge does not freely flow onto the conveyor belt 28. It should be noted that one of the sides 88*a* of the embodiment shown is sloped more steeply than the other side 88*b*. This increased slope of side 88*b* provides a larger storage space on that side of the water tank 42 within the aggregate bin 14. This larger storage space permits the aggregate bin 14 to store the separate aggregate components in a proportion that matches the concrete recipe. According to a common recipe for concrete, more rock aggregate by volume is used as compared to sand aggregate, such that the rock aggregate might be stored on the 88*a* side, such that the aggregate bin 14 will hold rock and sand aggregate that will make roughly the same amount of concrete.

The stability of the mobile mixer is improved by the location and shape of the water tank 42 within the aggregate bin 14. Specifically, the water tank 42 is relatively long and narrow, such that all of its weight is located very close to the longitudinal center of the truck 12. Furthermore, the water tank 42 is mounted to extend to the bottom of the aggregate bin 14, which keeps the center of gravity of the water and water tank 42 relatively low. Additionally, internal baffles 74 reduce sloshing of water, which in turn improves stability, especially during cornering and on side grades.

In operation, the water tank 42 is filled with water using inlet 62. Aggregate is loaded into the aggregate bin 14. If desired, separate types of aggregate may be placed on opposite sides of the water tank 42 without mixing. The water tank 42 acts as a divider to keep the two types of aggregate separate from each other. Dry cement powder is loaded into cement bin 16. There may be additional additives provided in other tanks or bins (not shown) on the truck 12, as is commonly known. A control system 41 is used to control and activate the various components. Power to the various components is provided by a hydraulics system 36 including hydraulic fluid. For example, the hydraulic fluid may be used to operate the mixer 30 and the conveyor belt 28. During a mixing operation, the conveyor belt 28 will continuously rotate beneath aggregate bin 14. Aggregate within the two sides of the bin 14 will drop onto the belt 28. The aggregate should freely flow onto the belt without impingement as a result of the sloped portion 88 of the tank 42. An adjustable gate (not shown) may be used to adjust the amount of aggregate provided by each rotation of the belt 28. As the aggregate is provided to the mixer 30, cement powder from the cement bin 16 is also provided to the mixer 30 via cement dispenser 34, and water is provided from water tank 42 to the mixer 30 via water conduit 32 connected to water outlet 64.

As the system operates, the hydraulic fluid will flow from the hydraulic system 36 through exhaust line 40 into inlet 82 of the hydraulic fluid reservoir 78. The hydraulic fluid will continue to flow across and through the divider plate 84 within the reservoir 78 and will be returned to the hydraulic system working components through the outlet openings 80 and suction line 38. The hydraulic fluid will be cooled by transferring heat to the water within tank 42. As a result of the high efficiency and capacity for removing heat of the large volume of water surrounding the hydraulic fluid reservoir 78, a relatively smaller amount of hydraulic fluid will be needed than would otherwise be necessary. Additionally, the warmed water within the water tank 42 will permit the concrete mixing unit 10 of the present invention to be used in lower temperature situations where the water and resulting mixture would otherwise be too cold.

A preferred embodiment of the present invention has been described above. It should be understood that modifications may be made in detail, especially matters of size, shape, and arrangement of parts. Such modifications are deemed to be within the scope of the present invention, which is to be limited only by the language of the claims, which are set forth below.

What is claimed is:

1. A mobile concrete mixing unit comprising:

a mobile frame;

an aggregate bin mounted to the mobile frame, the aggregate bin including a front wall, a rear wall, and sidewalls that span between the front and rear walls, each of the sidewalls sloping inwardly towards each other at a lower portion;

a water tank located within the aggregate bin, the water tank spanning between the front wall and the rear wall, the water tank dividing an upper portion of the aggregate bin into a first storage area and a second storage area, the first and second storage areas being open at their lower ends, the water tank including a water outlet for dispensing water;

a conveyor belt mounted to the mobile frame below the lower ends of the first and second storage areas;

a hydraulics system for providing power to the mixing unit, the hydraulics system including a reservoir of hydraulic fluid, the reservoir of hydraulic fluid being located at least partially within the water tank;

a cement bin mounted on the mobile frame; and a control system to control operation of the conveyor belt, hydraulics system, and water outlet to mix aggregate from the aggregate bin, cement from the cement bin, and water from the water tank to form a concrete mixture, whereby heat from the hydraulics system is transferred into water within the water tank to cool the hydraulics system and warm the water within the water tank.

2. The mobile concrete mixing unit of claim 1, wherein:

a lower portion of the water tank slopes downwardly and inwardly to prevent aggregate within the aggregate bin from bridging.

3. The mobile concrete mixing unit of claim 2, further comprising a first baffle within the water tank.

4. The mobile concrete mixing unit of claim 3, wherein the first baffle comprises a first plate spanning across a width of the water tank, the first plate including a plurality of openings to permit flow of water through the first baffle.

5. The mobile concrete mixing unit of claim 4, further comprising a second baffle within the water tank spanning across the width of the water tank, the second baffle having a second plate including a second plurality of openings to permit flow of water through the second baffle.

6. The mobile concrete mixing unit of claim 2, further comprising a divider flange extending downwardly from the lower portion of the water tank towards the belt.

7. The mobile concrete mixing unit of claim 6, further comprising a resilient separator mounted to the divider flange and extending below the divider flange into close engagement with the belt.

8. The mobile concrete mixing unit of claim 1, wherein the reservoir of hydraulic fluid includes a hydraulic fluid inlet connected to an outlet of the hydraulics system and a hydraulic fluid outlet connected to a suction line of the hydraulics system; and wherein the reservoir of hydraulic fluid includes a hydraulic divider plate separating the hydraulic fluid inlet and the hydraulic fluid outlet to cause a flow of hydraulic fluid within the reservoir to thereby increase heat transfer between the hydraulic fluid within the reservoir and the water within the water tank.

9. The mobile concrete mixing unit of claim 1, further comprising:

a support rod mounted between one of the sidewalls of the aggregate bin and a sidewall of the water tank.

10. The mobile concrete mixing unit of claim 9, wherein the mobile frame includes a plurality of ribs that support the aggregate bin on the mobile frame, and further wherein the support rod is aligned with one of the ribs.

11. The mobile concrete mixing unit of claim 1, wherein a portion of the water tank extends through the rear wall of the aggregate bin.

12. A mobile concrete mixing unit comprising:

a mobile frame;

an aggregate bin mounted to the mobile frame, the aggregate bin including a front wall, a rear wall, and sidewalls that span between the front and rear walls, each of the sidewalls sloping inwardly towards each other at a lower portion;

a water tank located within the aggregate bin, the water tank spanning between the front wall and the rear wall, the water tank dividing an upper portion of the aggregate bin into a first storage area and a second storage area, the first and second storage areas being open at their lower ends, the water tank including a water outlet for dispensing water;

a conveyor belt mounted on the mobile frame below the lower ends of the first and second storage areas;

wherein a lower portion of the water tank slopes inwardly away from the sidewalls of the aggregate bin whereby a cavity between the lower portion of the water tank and the sidewalls of the aggregate bin prevents aggregate within the aggregate bin from bridging between the sidewalls of the aggregate bin and the lower portion of the water tank;

a hydraulics system for providing power to the mixing unit, the hydraulics system including a reservoir of hydraulic fluid, the reservoir of hydraulic fluid being located within the water tank; and a control system to control operation of the conveyor belt, hydraulics system, and water outlet to mix aggregate from the aggregate bin, cement from a cement bin, and water from the water tank to form a concrete mixture, whereby heat from the hydraulic system is transferred into water within the water tank to cool the hydraulics system and warm the water within the water tank.

13. The mobile concrete mixing unit of claim 12, further comprising a first baffle within the water tank.

14. The mobile concrete mixing unit of claim 13, wherein the first baffle comprises a first plate spanning across a width of the water tank, the first plate including a plurality of openings to permit flow of water through the first baffle.

15. The mobile concrete mixing unit of claim 14, further comprising a second baffle within the water tank spanning across the width of the water tank, the second baffle having a second plate including a second plurality of opening to permit flow of water through the second baffle.

16. The mobile concrete mixing unit of claim 15, further comprising a divider flange extending downwardly from the lower portion of the water tank towards the belt.

17. The mobile concrete mixing unit of claim 16, further comprising a resilient separator mounted to the divider flange and extending below the divider flange into close engagement with the belt.

18. The mobile concrete mixing unit of claim 12, wherein the reservoir of hydraulic fluid includes a hydraulic fluid inlet connected to an outlet of the hydraulics system and a hydraulic fluid outlet connected to a suction line of the hydraulics system; and wherein the reservoir of hydraulic fluid includes a divider plate separating the hydraulic fluid inlet and the hydraulic fluid outlet to cause a flow of hydraulic fluid within the reservoir to thereby increase heat transfer between the hydraulic fluid within the reservoir and the water within the water tank.

19. The mobile concrete mixing unit of claim 12, further comprising:

a support rod mounted between one of the sidewalls of the aggregate bin and a sidewall of the water tank.

20. The mobile concrete mixing unit of claim 19, wherein the mobile frame includes a plurality of ribs that support the aggregate bin on the mobile frame, and further wherein the support rod is aligned with one of the ribs.

* * * * *